US007385481B2

(12) United States Patent
Sommers et al.

(10) Patent No.: US 7,385,481 B2
(45) Date of Patent: Jun. 10, 2008

(54) METHOD AND APPARATUS FOR TRI-COLOR RAIL SIGNAL SYSTEM WITH CONTROL

(75) Inventors: Matthew Sommers, Sagamore Hills, OH (US); Chris Bohler, North Royalton, OH (US); Patrick Martineau, Valley View, OH (US); Louis Brunet, Valley View, OH (US)

(73) Assignee: Lumination LLC, Valley View, OH (US)

( * ) Notice: Subject to any disclaimer, the term of this patent is extended or adjusted under 35 U.S.C. 154(b) by 74 days.

(21) Appl. No.: 10/753,580

(22) Filed: Jan. 8, 2004

(65) Prior Publication Data

US 2005/0151665 A1 Jul. 14, 2005

(51) Int. Cl.
*G08B 23/00* (2006.01)

(52) U.S. Cl. ..... 340/321; 340/907; 340/815.4; 340/468; 340/469; 340/635; 340/641; 340/815.41; 340/815.47; 362/543; 362/545; 362/227; 362/236

(58) Field of Classification Search ..... 340/321, 340/907, 815.4, 468, 469, 463, 635, 641, 340/815.47, 815.41; 362/543, 545, 227, 362/236

See application file for complete search history.

(56) References Cited

U.S. PATENT DOCUMENTS 2,376,534 A * 5/1945 Field ..... 246/473.3
4,273,999 A * 6/1981 Pierpoint ..... 250/205
4,536,847 A * 8/1985 Erickson et al. ..... 702/150
4,629,941 A * 12/1986 Ellis et al. ..... 315/153
5,451,017 A * 9/1995 Graff et al. ..... 246/220
5,471,052 A * 11/1995 Ryczek ..... 250/226
5,939,996 A * 8/1999 Kniveton et al. ..... 340/815.4
5,952,917 A * 9/1999 Zimmermann et al. ..... 340/469
6,144,161 A * 11/2000 Kimmich et al. ..... 315/159
6,439,743 B1 8/2002 Hutchison
6,445,139 B1 * 9/2002 Marshall et al. ..... 315/291
6,450,662 B1 9/2002 Hutchison
6,474,839 B1 11/2002 Hutchison
6,495,964 B1 * 12/2002 Muthu et al. ..... 315/149
6,509,840 B2 1/2003 Martineau
6,527,422 B1 * 3/2003 Hutchison ..... 362/373
6,568,109 B2 * 5/2003 Sanders ..... 40/447
6,809,655 B1 * 10/2004 Colby ..... 340/907

OTHER PUBLICATIONS

J. Bullough, et al. "Optimizing the Design and Use of Light-Emitting Diodes for Visually Critical Applications in Transportation and Architechture" © 2000 Lighting Research Center, Rensselaer Polytechnic Institute, and Pacific Gas and Electric Company http://www.lrc.rpi.edu/Ltgtrans/LED/led-tech.html, 2 pages.

* cited by examiner

*Primary Examiner*—George A Bugg
*Assistant Examiner*—Daniel Previl
(74) *Attorney, Agent, or Firm*—Fay Sharpe LLP

(57) ABSTRACT

A signaling control device apparatus (10) comprises at least one LED (20) having a light emitting surface (18). A sensor (24) is set to detect an external light load (16) directed to the light emitting surface (18) and generate a control signal indicative of a presence of the light load (16). An electrical control system (14) detects the control signal indicative of the light load (16) and sources an elevated current to the LED (20) while the light load (16) is present. The elevated current increases the contrast ratio making the signal perceivable by the users as being in a particular state.

12 Claims, 4 Drawing Sheets

METHOD AND APPARATUS FOR TRI-COLOR RAIL SIGNAL SYSTEM WITH CONTROL

BACKGROUND

The present application relates to the field of signaling devices. Although described with particular application to LED rail and traffic signaling applications, it is to be appreciated that the present application is applicable to other types of signaling devices and operations including, but not limited to, transit, pedestrian, automobile, truck, and marine signaling devices. Those skilled in the art will appreciate applicability of the present application to the applications where it is desirable to reduce the effect of external light loading on signaling devices.

Traditionally, traffic lights have used light bulbs in order to produce light. A colored filter was installed in front of each bulb for producing one of the three traffic lights common colors. However, traffic lights using this technology have some drawbacks. One, the bulbs power consumption is high (each being between 100 W and 160 W), increasing the operation costs. Another problem is the short lifetime of the bulb which decreases with environmental conditions such as vibration and temperature.

LED signal modules are rapidly becoming the world standard for replacing conventional incandescent signal lamps. In recent years, their high-energy efficiency and super-long lives have helped colored LEDs make inroads into applications such as traffic signals and exit signs, interior auto lights and outdoor signs. LED traffic signals offer many benefits that can reduce overall operating and maintenance costs. Reportedly, thirty five to forty percent of traffic signals in North America have been converted to LEDs as municipalities seek to reduce maintenance and energy costs. Some LEDs might last as long as five years in traffic signals and result in energy savings of up to as much as ninety percent.

However, there are certain problems associated with the use of LEDs for signal applications. For example, when the sun or another source of an oncoming light strikes the LED signal head, light enters the system and reflects back out providing a false white signal indication or a washed out indication of other colors. As a result, users do not recognize the traffic signals correctly.

Several solutions have been offered to solve this problem, none of which has produced adequate results. Louvers and sun shields do not help with the oncoming light sources. Another solution is to tin the LEDs. This causes false white positives when the oncoming light strikes the signal head. Polarizing filters have proved to be of little help, since the light entering the system does not show significant polarization. The present application contemplates a new and improved method and apparatus that overcomes the above-referenced problems and others.

BRIEF DESCRIPTION

In accordance with one aspect of the present application, a signaling control device apparatus is disclosed. The signaling control device comprises a light source, comprising at least one LED and having a light emitting surface. At least one sensor is set to detect an external light load directed to the light emitting surface and generate a control signal indicative of a presence of the light load.

In accordance with another aspect of the present application, a method of controlling a signaling device is disclosed.

A light source comprising a plurality of LEDs and having a light emitting surface is provided. At least one sensor is set to detect an external light load directed to the light emitting surface. In response to detecting a presence of the light load, the at least one sensor generates a control signal indicative of detecting the light load.

One advantage of the system is driving LEDs at the higher current only when the light load is present to overcome the false signal indication and contrast reduction issues.

Another advantage of the system is quick and inexpensive solution to overcome the false signal indication and contrast reduction issues.

Still further advantages and benefits of the present application will become apparent to those of ordinary skill in the art upon reading and understanding the following detailed description of the preferred embodiments.

DETAILED DESCRIPTION

Figure 1:
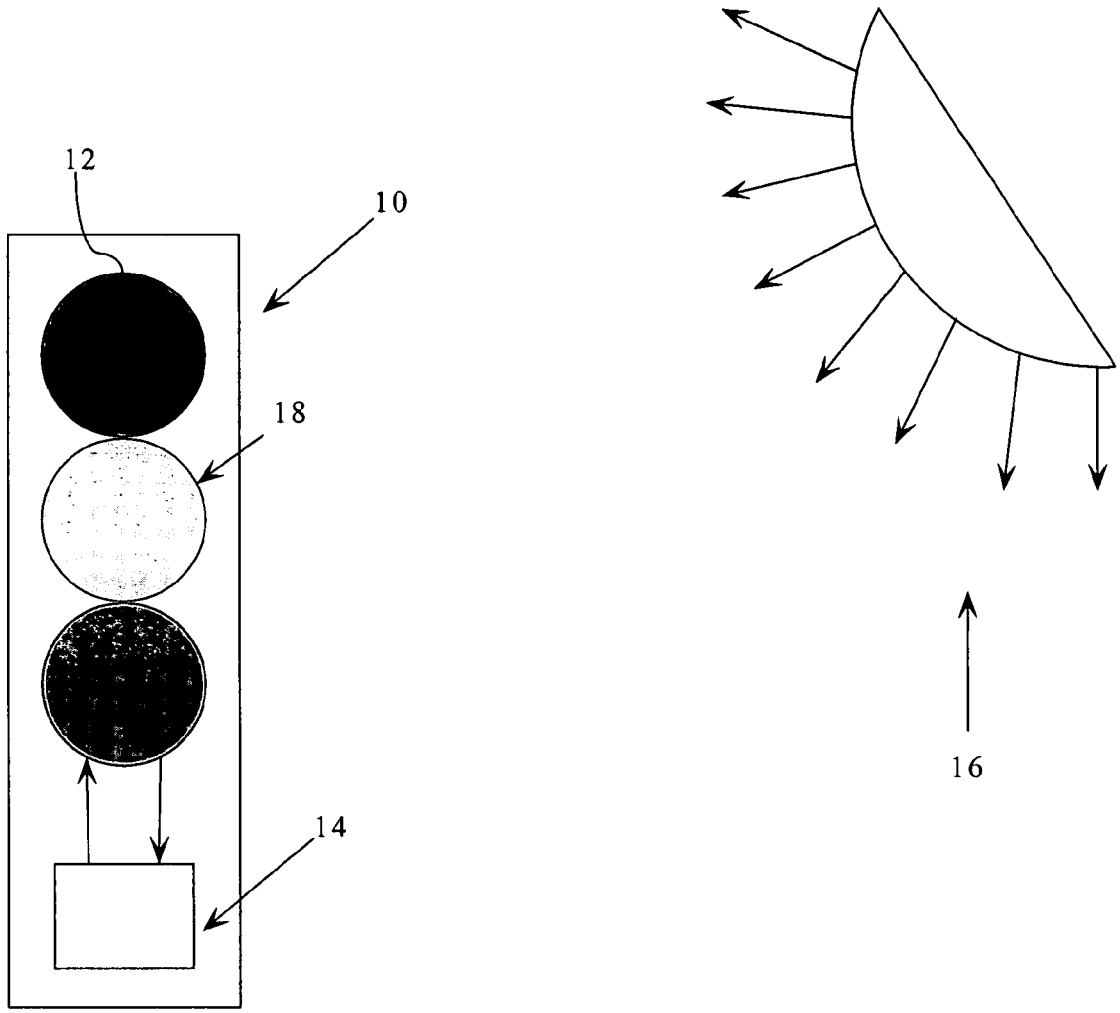
FIG. 1 is a view of a conventional traffic signal.

With reference to FIG. 1, a conventional traffic signaling device 10 such as the ever-present three-color (red, yellow, green) traffic control signal is schematically shown. The signaling device 10 is suitable for providing the red, yellow, or green light of a three-color traffic signal, and includes solid state light 12, which emits light when driven by an electrical current. Light produced by the light 12 is collected by signaling device optics (not shown) that may include a reflector, which is typically a parabolic reflector, and a lens to produce a light beam outwardly directed from the signaling device 10 with a suitable beam spread. The beam spread should be narrow enough to direct the light toward roadway users with a high degree of efficiency, but wide enough so that roadway users including pedestrians at the periphery of the road and drivers a substantial distance from the intersection can readily see the signal.

The signaling device 10 might include a cover to protect light 12 from dirt and dust. The cover may optionally include additional elements such as a visor or a tinted filter for spectrally filtering the light to produce a red, green, or yellow output. For traffic signal devices providing a shaped light such as a left turn arrow, an "X" lane marker indicating "wrong way", a pedestrian "walk" or "don't walk" signal, or the like, a masking filter is typically included with the cover to define the selected shape.

The signaling device 10 includes an electrical control circuit 14, which preferably includes an electric power conditioning electronics. As it is known to those skilled in the art, incandescent traffic lights are typically powered by the AC electrical voltage sources in the range of about 80-135 volts (for the nominally 120 VAC standard) or about 185-275 volts (for the nominally 220 VAC standard), and typically draw hundreds of milliamperes of current. In one embodiment, the solid state light 12 includes a plurality of LEDs each operating at a few volts DC and drawing a few tens of milliamperes of current. The electrical control circuit 14 receives electrical power from the AC power source and conditions the electrical power to operate the solid state light 12.

In one embodiment, the conditioning electronics includes a switching power supply (not shown) for converting the AC line voltage to a DC rectified current adapted for powering the solid state light 12. Preferably, the switching power supply has a high power factor and low current harmonic distortion. Advantageously, the switching power supply has a low power loss and, preferably, includes the capability of controlling the output current to optimally drive the light 12.

With further reference to FIG. 1, a source of an external light load 16 such as sun or any other source of an oncoming illumination enters the system striking a light emitting face 18. The light reflects back providing a false white signal or a washed out indication of other colors.

Figure 2:
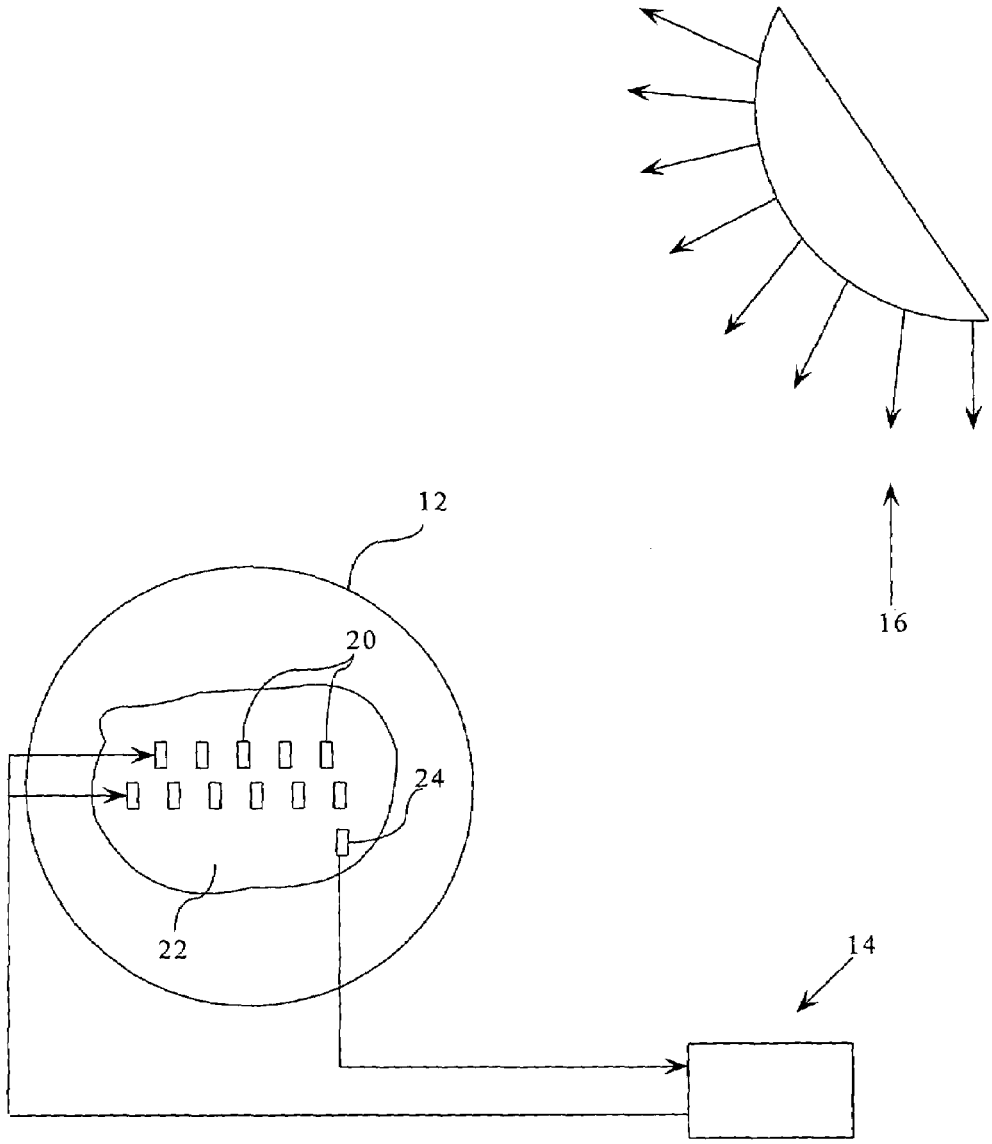
FIG. 2 is a view of a solid state signal light.

With reference to FIG. 2, light emitting diodes 20 (LEDs) are mounted on an interface board such as a printed circuit board 22. In one embodiment, the LEDs 20 are white light-emitting LEDs such as white light-emitting phosphor-coated ultraviolet GaN LEDs. The use of white light-emitting LEDs makes the light 12 a spectrally close retro-fit for the conventional incandescent light bulb used in the signaling devices that typically emits white light. Such retro-fit light 12 employing white light-emitting LEDs, is preferably used for retro-fitting any of the red, yellow, or green bulbs of the conventional three-color traffic light.

In another embodiment, the LEDs 20 include colored LEDs which produce light predominantly in the selected filter pass-band. Thus, red LEDs are advantageously employed for retro-fitting a red traffic light ball, yellow LEDs are employed for retro-fitting a yellow traffic light ball, and green LEDs are employed for retro-fitting a green traffic light ball. Preferably, the suitable colored LEDs include AlGaInP-based LEDs and GaN-based LEDs with or without phosphor coatings. Of course, it is also contemplated that other LEDs with suitable optical characteristics might be used. Preferably, when the colored LEDs are used, a multiple-layer dielectric stack mirror is employed, which is tuned to have a high reflectivity over a selected spectral range which coincides with the colored LED light output.

With further reference to FIG. 2, a sensing device 24 such as a photodiode is located on the same printed circuit board as LEDs 20. Preferably, the sensing device 24 is protected from the light emitted by the LEDs 20 by a baffle. Alternatively, the sensing device 24 is located in a remote enclosure. The advantage of the remote location is the better means for orienting and aligning the sensing device 24 towards the source of the oncoming illumination 16. It is particularly useful if the signaling device 10 is positioned on sharp bends or transit.

Figure 3:
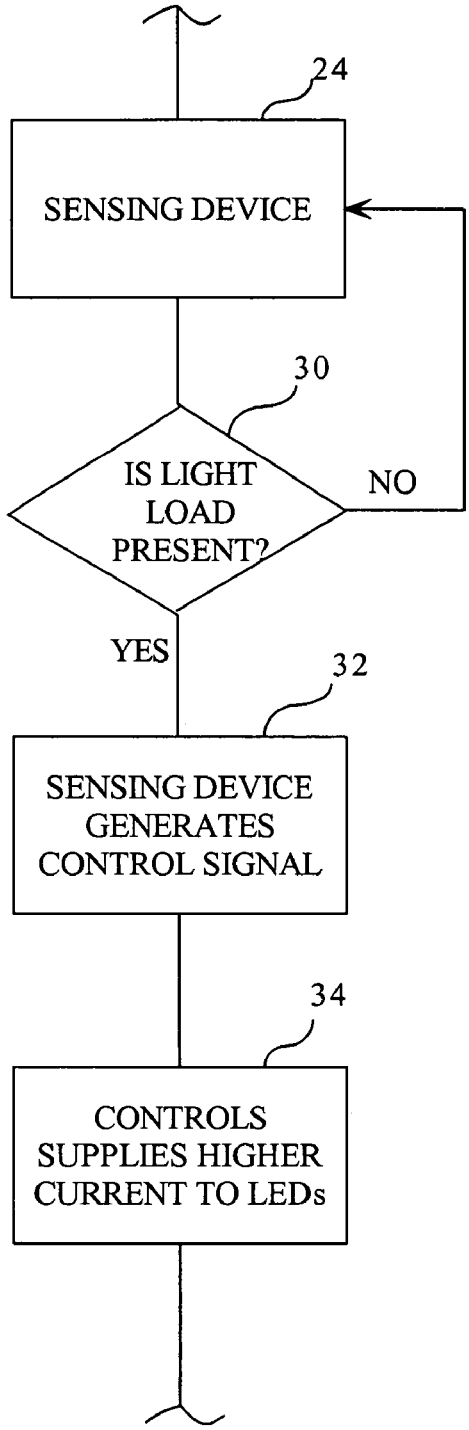
FIG. 3 is a flowchart of a method of supplying a higher current to the LEDs while the light load is present.

With reference to FIG. 3, in a step 30 the sensing device 24 is detecting if any source of the oncoming illumination 16 is shining towards the light emitting surface 18. If the oncoming illumination is detected by the sensing device 24, in a step 32, a control signal is generated. The control signal is received by an electrical control system 14, which, in a step 34, generates and supplies a higher current to the LEDs 20, preferably while the light load 16 is present.

Figure 4:
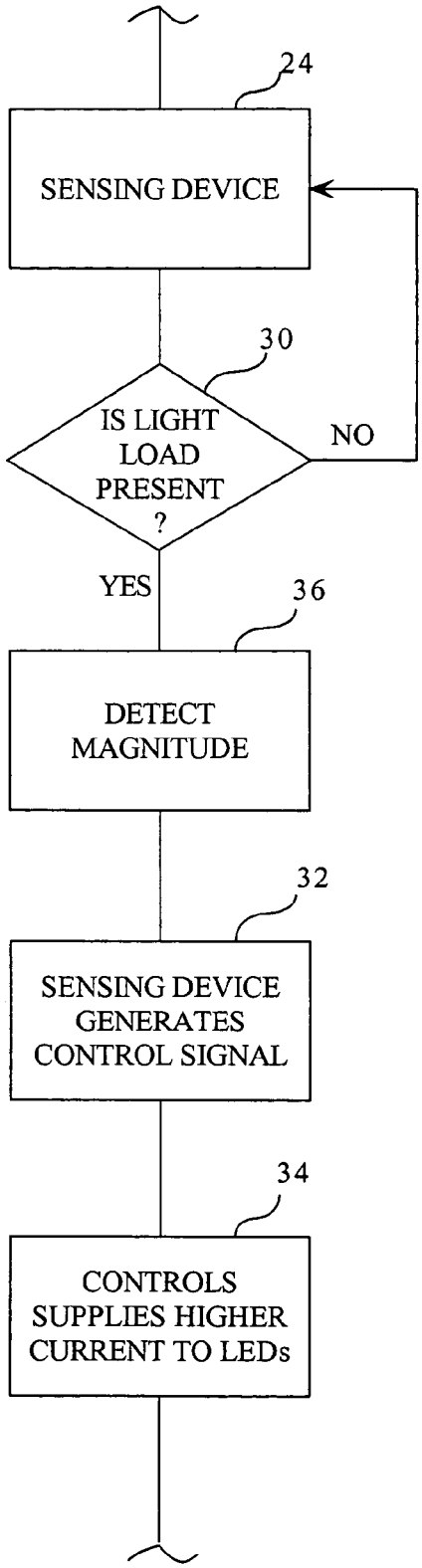
FIG. 4 is a flowchart of a method of supplying a higher current to the LEDs taking into consideration a magnitude of the light load.

With reference to FIG. 4, in a step 36 the sensing device 24 detects a magnitude of the light load 16. In the step 32, the sensing device 24 generates the control signal indicative of a value of the magnitude. The signal is received by an electrical control system 14. In the step 34, the control system generates the higher current in proportion to the magnitude of the light load 16 and supplies it to the LEDs 20. In one embodiment, the control system 16 is a close loop feedback control system, adjusting the current in proportion to the magnitude of the light load 16 on the fly.

Preferably, in the step 34, the control system 16 generates a continuous higher current. Alternatively, the increased current is supplied as a pulse, causing a blinking effect. The blinking current goes from a standard operating state to a raised state in intensity and then back down again, not perceived as blinking off, but blinking brighter. In yet another embodiment, the current is raised in a modified fashion to appear constantly on, but at a higher intensity, by pulsing the current at a frequency higher than visually perceivable.

The exemplary embodiment has been described with reference to the illustrated embodiments. Modifications and alterations will occur to others upon a reading and understanding of the preceding detailed description. It is intended that the exemplary embodiment be construed as including all such modifications and alterations insofar as they come within the scope of the appended claims or the equivalents thereof.

What is claimed is:

1. A signaling control device apparatus comprising:

a light source including at least one LED, the light source having a light emitting surface;

at least one sensor set to detect an external light load directed to the light emitting surface and generate a control signal indicative of a presence of the external light load, the external light load being one of sunlight and a light from approaching train headlights; and an electrical control system for receiving the control signal indicative of the presence of the external light load and triggering an increase in current being supplied to the at least one LED in response to the received control signal which increased current is being maintained for at least while the external light load is present;

wherein the at least one LED and the at least one sensor are disposed on a same printed circuit board; and wherein the current is raised by pulsing the current to cause the at least one LED to pulse at a frequency higher than visually perceivable.

2. The apparatus as set forth in claim 1, wherein the at least one sensor includes a photodiode.

3. The apparatus as set forth in claim 1, wherein the at least one sensor detects a magnitude of the light load and wherein the control system receives a control signal indicative of a value of the magnitude of the load and generates an increased current to be supplied to the at least one LED in proportion to the load magnitude.

4. A method of controlling a signaling device, the method comprising:

providing a light source including at least one LED, the light source having a light emitting surface;

setting at least one sensor to detect an external light load directed to the light emitting surface, the external light load being one of sunlight and a light from approaching train headlights;

mounting the at least one sensor in an enclosure in a location remote from the light source;

in response to detecting a presence of the external light load, generating a control signal indicative of detecting the external light load;

receiving the control signal by an electrical control system;

triggering an increase in current being supplied to the at least one LED in response to receiving the control signal; and maintaining the elevated current for at least while the external light load is present;

wherein the current is raised by pulsing the current to cause the at least one LED to pulse at a frequency higher than visually perceivable.

5. The method as set forth in claim 4, wherein the at least one sensor includes a photodiode.

6. The method as set forth in claim 4, further including: mounting the at least one LED on a printed circuit board.

7. The method as set forth in claim 4, further including: one of supplying a continuous current and a pulsing current.

8. The method as set forth in claim 4, further including: detecting a magnitude of the light load; and generating an output control signal indicative of a value of the light load magnitude.

9. The method as set forth in claim 8, further including: receiving the magnitude value by the electrical control system; and supplying the elevated current to the at least one LED, the elevated current being proportionate to the detected light load magnitude.

10. The method as set forth in claim 9, further including: continually adjusting a value of the elevated current based on the detected light load magnitude.

11. The method as set forth in claim 4, wherein the signaling device includes a rail signaling device and further including:

positioning the rail signaling device on a sharp bend; and orienting the remotely positioned sensor along the bend towards a direction of the light of the approaching train headlights which train is approaching the rail signaling device from beyond the bend.

12. A rail signaling system comprising:

a rail signaling device including at least one LED, the rail signaling device having a light emitting surface;

at least one sensor set to detect an external light load directed to the light emitting surface and generate a control signal indicative of a presence of the external light load, the external light load being one of sunlight and a light from approaching train headlights; and an electrical control system for receiving the control signal indicative of the presence of the external light load and triggering an increase in current being supplied to the LED in response to the received control signal which increased current is being maintained for at least while the detected external light load is present;

wherein the signaling device is positioned on a sharp bend and the sensor is in an enclosure positioned remotely from the signaling device alongside the bend so that the sensor is oriented toward the light of the approaching train headlights which train is approaching the rail signaling device from beyond the sharp bend; and wherein the current is raised by pulsing the current to cause the at least one LED to pulse at a frequency higher than visually perceivable.

* * * * *